US008249289B2

(12) United States Patent
Mizuno et al.

(10) Patent No.: US 8,249,289 B2
(45) Date of Patent: Aug. 21, 2012

(54) ELECTRONIC APPARATUS OF SPLITTABLE TYPE

(75) Inventors: Hajime Mizuno, Shanghai (CN); Zhixiong Yao, Shanghai (CN); Shen Cheng, Shanghai (CN)

(73) Assignee: Sony (China) Limited, Beijing (CN)

( * ) Notice: Subject to any disclaimer, the term of this patent is extended or adjusted under 35 U.S.C. 154(b) by 1003 days.

(21) Appl. No.: 12/235,099

(22) Filed: Sep. 22, 2008

(65) Prior Publication Data

US 2009/0092268 A1 Apr. 9, 2009

(30) Foreign Application Priority Data

Sep. 21, 2007 (CN) ..... 2007 1 0149899

(51) Int. Cl.
*H04R 1/02* (2006.01)

(52) U.S. Cl. ..... 381/387; 381/182; 381/386; 381/395

(58) Field of Classification Search ..... 381/182, 381/386, 387, 395
See application file for complete search history.

(56) References Cited

U.S. PATENT DOCUMENTS 4,535,870 A * 8/1985 Lindsay ..... 181/141
5,092,424 A 3/1992 Schreiber et al.
5,982,537 A * 11/1999 Koizumi et al. ..... 359/444
7,151,912 B1 * 12/2006 Morrison ..... 455/90.3
2005/0031148 A1 * 2/2005 McNary ..... 381/334
2005/0058316 A1 * 3/2005 Yanagishita et al. ..... 381/371
2006/0013429 A1 * 1/2006 Ohta ..... 381/370
2007/0017834 A1 * 1/2007 Chang et al. ..... 206/312

OTHER PUBLICATIONS

Thomas Ricker, "Sofmap's Digital Olive DAP: an olive, not an egg", Jul. 12, 2007, 1 page.

* cited by examiner

*Primary Examiner* — Tom Thomas

*Assistant Examiner* — Christopher M Roland

(74) *Attorney, Agent, or Firm* — Oblon, Spivak, McClelland, Maier & Neustadt, L.L.P.

(57) ABSTRACT

The present invention discloses an electronic apparatus of splittable type comprising at least two speaker portions, the two speaker portions are connected by electro-wires, wherein in one speaker portion is provided a winding mechanism for pulling-out and retracting-in the electro-wires; each of the speaker portions has a voice chamber, and the voice chambers in the two speaker portions have the different shapes from but substantially the same volumes as each other.

15 Claims, 11 Drawing Sheets

ELECTRONIC APPARATUS OF SPLITTABLE TYPE

FIELD OF INVENTION

The present invention relates to an electronic apparatus of splittable type, more specifically, to an electronic apparatus of splittable type comprising at least two speaker portions.

BACKGROUND OF INVENTION

For an electronic apparatus of splittable type required to create the stereosonic effect, the users wish that two or more speaker portions can be jointed and separated quickly and simply so as to carry the electronic apparatus of splittable type easily. Meanwhile, the number of the jointing members between two speaker portions should be as less as possible, and the integrity and the beauty of the appearances of the speaker portions should not be influenced after being jointed and separated frequently. In order to achieve the miniaturization of the electronic apparatus of splittable type, the efficacy per unit volume of each speaker portion should be as high as possible, which is a target having been sought by the manufacturers all along. Up to now, however, in the electronic apparatus of splittable type comprising two or more speaker portions, the speaker portions having no joint-separate relationship in general, which are separated from one another and stored alone, typically should be electro-connected by the external wires when being used. Alternatively, even though these speaker portions have the joint-separate relationship, they are jointed substantially by way of rotary engagement, buckling, buttons or bolts, these conventional jointing mechanisms being troublesome and time-consuming in operation and the surfaces of the jointed portions being liable to be scratched and worn, resulting in the beauty and lifespan of products being affected.

For example, with a sound case, many users wish to enjoy the stereosonic effect in outdoor entertainments, so that they should often carry two or more miniature sound cases, which are separated by a proper space when being used and connected using wires to the audio electronic signal outputting devices such as PMP (Portable Media Player), PDA (Personal Digital Assistant) or portable computer. After entertainments, the wires must be removed and rewound respectively, the sound cases must be handled carefully, these sequential operations spend a lot of time and effort and deteriorate the enjoying quality very much even eliminate the "true portable music enjoyment", in addition, these frequent operations would scratch the outer surfaces of the sound cases and shorten the lifespan thereof. Therefore, it is the urgent requirement of the users that the product designers should develop a portable sound case which has a small and exquisite figure so as to be carried easily but excellent tone quality, and can be jointed and separated simply and quickly. Of course, in order to achieve the miniaturization, it is necessary to contain the components in the sound case as much as possible on the premise that the tone quality of the sound case does not be lowed. The voice chamber is an inner case which is provided directly with a speaker and resonated with the speaker. On the other hand, because the conventional structure of voice chamber, for example, a voice chamber with a rectangular shape in section, is difficult to form a sound case in compact structure to meet the requirement of miniaturization in the particular environment, the structure of the voice chamber of the prior art must be improved in order to make use of the containing space of the sound case sufficiently.

SUMMARY

In order to overcome the shortcomings that the speaker portions of the electronic apparatus of splittable type comprising at least two speaker portions of the prior art can not be jointed and separated perfectly and like, and resolve the problem that the structure of the speaker portion of the prior art is not advantageous to use and to carry easily, an object of the present invention is to provide a ingenious electronic apparatus of splittable type comprising at least two speaker portions; another object of the present invention is to provide an electronic apparatus of splittable type comprising at least two speaker portions which is advantageous to joint and separate.

In order to achieve the above-mentioned objects, the present invention adopts the following technical solution.

An electronic apparatus of splittable type comprising at least two speaker portions, wherein the two speaker portions are connected by electro-wires (or called as conductive connecting line), one of them has a winding mechanism for retracting-in and pulling-out the electro-wires; each of the speaker portions has a voice chamber, and the voice chambers of two speaker portions have the different shapes from and substantially the same volumes as each other.

The above electronic apparatus of splittable type preferably further comprises a jointing mechanism for jointing and separating two speaker portions, the jointing mechanism comprises a first surface at one of the two speaker portions and a second surface at the other, and the first surface and the second surface are opposed to each other when the two speaker portions are jointed together by the jointing mechanism.

In the above electronic apparatus of splittable type, the connecting positions of the electro-wires are preferably at the centers of the first surface and the second surface.

In the above electronic apparatus of splittable type, the winding mechanism comprises preferably a retraction-controlling part for controlling the automatic retraction of electro-wires.

The electronic apparatus of splittable type of the present invention has a compact structure advantageous to achieve the miniaturization and the portability; and when the two or more speaker portions of the electronic apparatus of splittable type are jointed or separated, the operative procedure is simple and can be carried out quickly, said two surfaces contacted with each other would not be damaged, and their appearances can be kept complete even though the apparatus has been subjected to frequent uses.

REFERENCE NUMBERS

Figure 1:
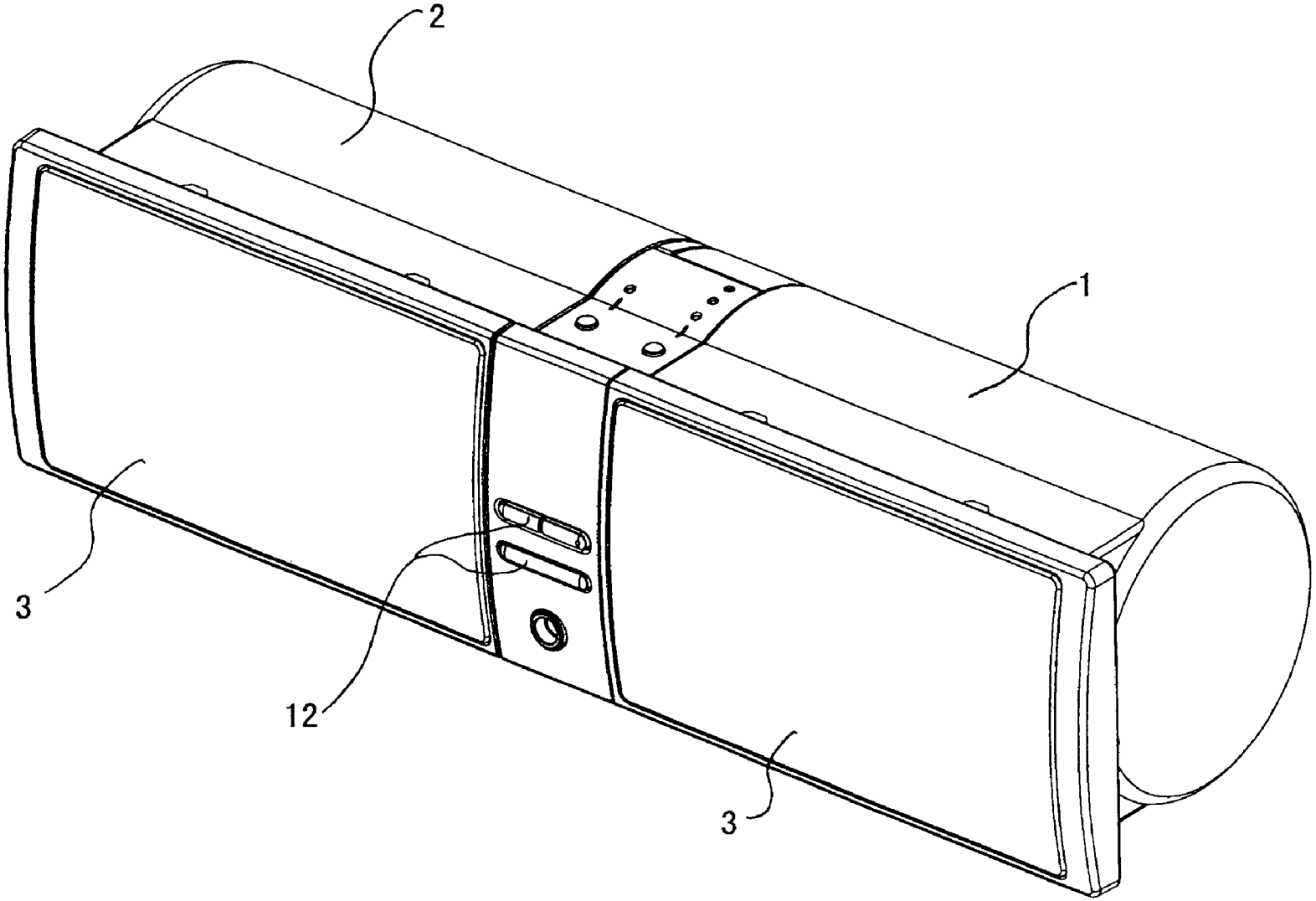
FIG. 1 is a schematic perspective view of the sound case of splittable type of an embodiment of the present invention in the jointed state easy to carry.

1 first speaker portion, first sound case
2 second speaker portion, second sound case
3 voice-outputting surface of sound case
10 first surface
11 first voice chamber
12 controlling key
13 cells
14 circuit board
15 signal-inputting terminal
101 main-body part
102 cover of cell box
103 pin
104 boss
105 guiding column, socket
1031 head of pin
1032 pillar of pin
20 second surface
203 pin hole
2031 key-inserting-hole part
2032 extending-hole part
2033 buckling member
204 butt-sliding area
205 guiding hole, electro-wire hole
21 voice chamber in second sound case
211 concave chute
212 chamber
2122 higher-step portion of chamber
213 speaker
214 voice-outputting module
2141 bottom of voice-outputting module
2142 U-shaped groove
2143 through-hole
2144 partitioning plate
2145 protruding structure
215 base plate
2151 U-shaped frame
2153 voice-outputting hole
22 winding mechanism
221 ratchet unit
222 lever
223 small spring
224 retraction-controlling member, retracting key
225 connector of electro-wires
226 electro-wires
227 wire roll

DETAILED DESCRIPTION OF EMBODIMENT

The preferred embodiment of the sound case of splittable type as a specific example of the electronic apparatus of splittable type embodying the conception of the present invention will be described with reference to the accompanying drawings as follows. It is understood that the embodiment is for the purpose of illustrating the present invention and should not be interpreted as a limitation to the scope of the invention.

The electronic apparatus of splittable type of the present invention refers mainly to the electronic apparatus of splittable type which adopts at least two speaker portions in combine and can achieve the stereosonic effect by means of the combined speaker portions. In addition to the speaker portions, the electronic apparatus may further comprise an audio electronic signal outputting device and a video electronic signal outputting device such as PMP, PDA, TV set or computer. The sound case of splittable type is a typical example of the electronic apparatus of splittable type.

The electronic apparatus of splittable type has at least two speaker portions, therefore, the simplest apparatus of this type is a sound case of splittable type containing two sound cases.

Speaker Portion

Figure 11:
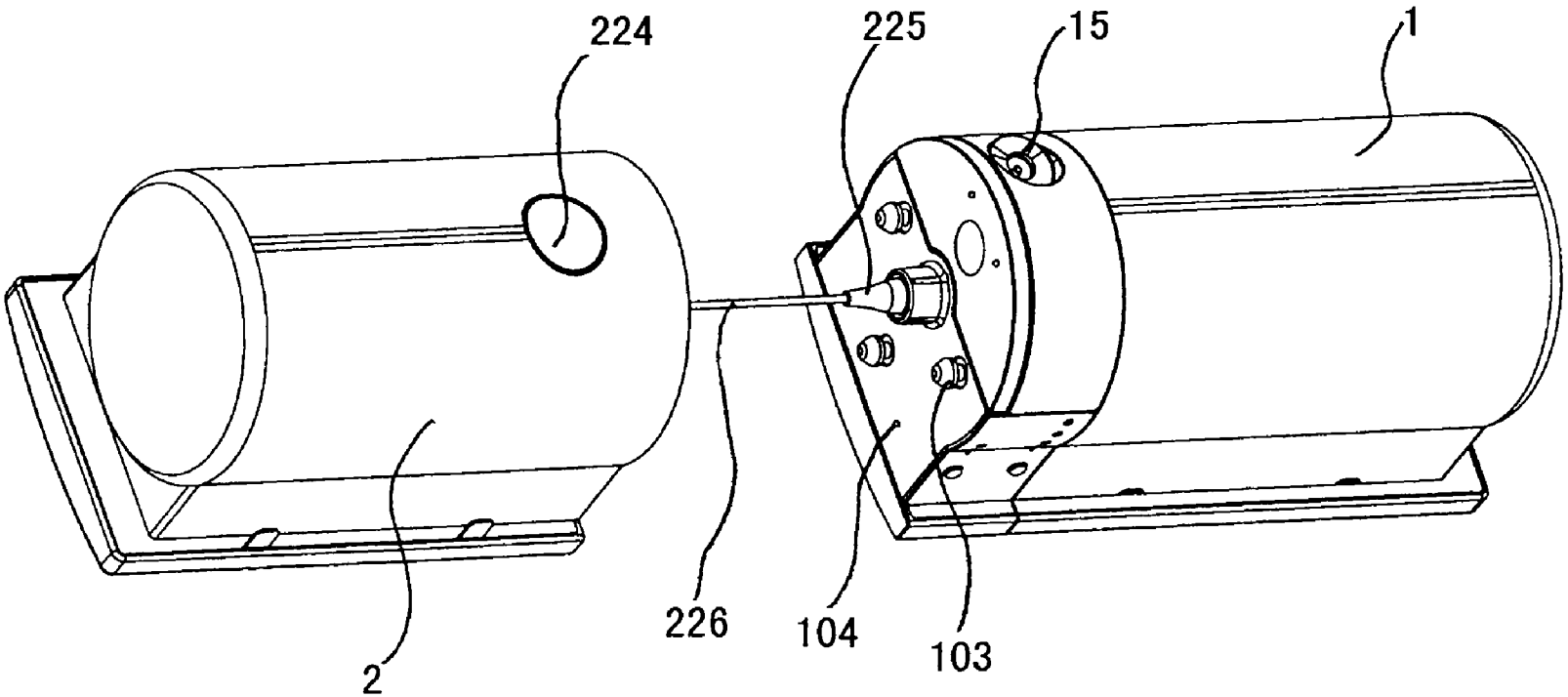
FIG. 11 is a schematic perspective view of the sound case of splittable type of an embodiment of the present invention in the operating state after being separated.

The appearance and the shape of the speaker portion are not limited, but should be beautiful, practical and easy to carry. For example, in the embodiment of sound case of splittable type comprising two sound cases i.e. two speaker portions described herein, as shown in FIG. 1 and FIG. 11, two speaker portions 1 and 2 (they will be referred to as first speaker portion 1 or first sound case 1 and second speaker portion 2 or second sound case 2 respectively in this embodiment) of the sound case of splittable type as electronic apparatus of splittable type assume substantially a semi-cylindrical shapes in outline, and their integral in jointed state assumes substantially the semi-cylindrical shape either. The semi-cylindrical shape is an aesthetic choice without concern with the structure of the present invention. The speakers of first sound case 1 and second sound case 2 are provided to face voice-outputting surfaces 3 of the semi-cylinders, wherein voice-outputting surfaces 3 are of plane or slight curve in section.

It is understood that above phrase "to assume substantially a semi-cylindrical shape" means that first sound case 1 and second sound case 2 of the sound case of splittable type assume a rough "semi-cycle" shape in section, but they are not limited to being semi-circular in section and can be extended or deformed properly in two dimensions.

Figure 3:
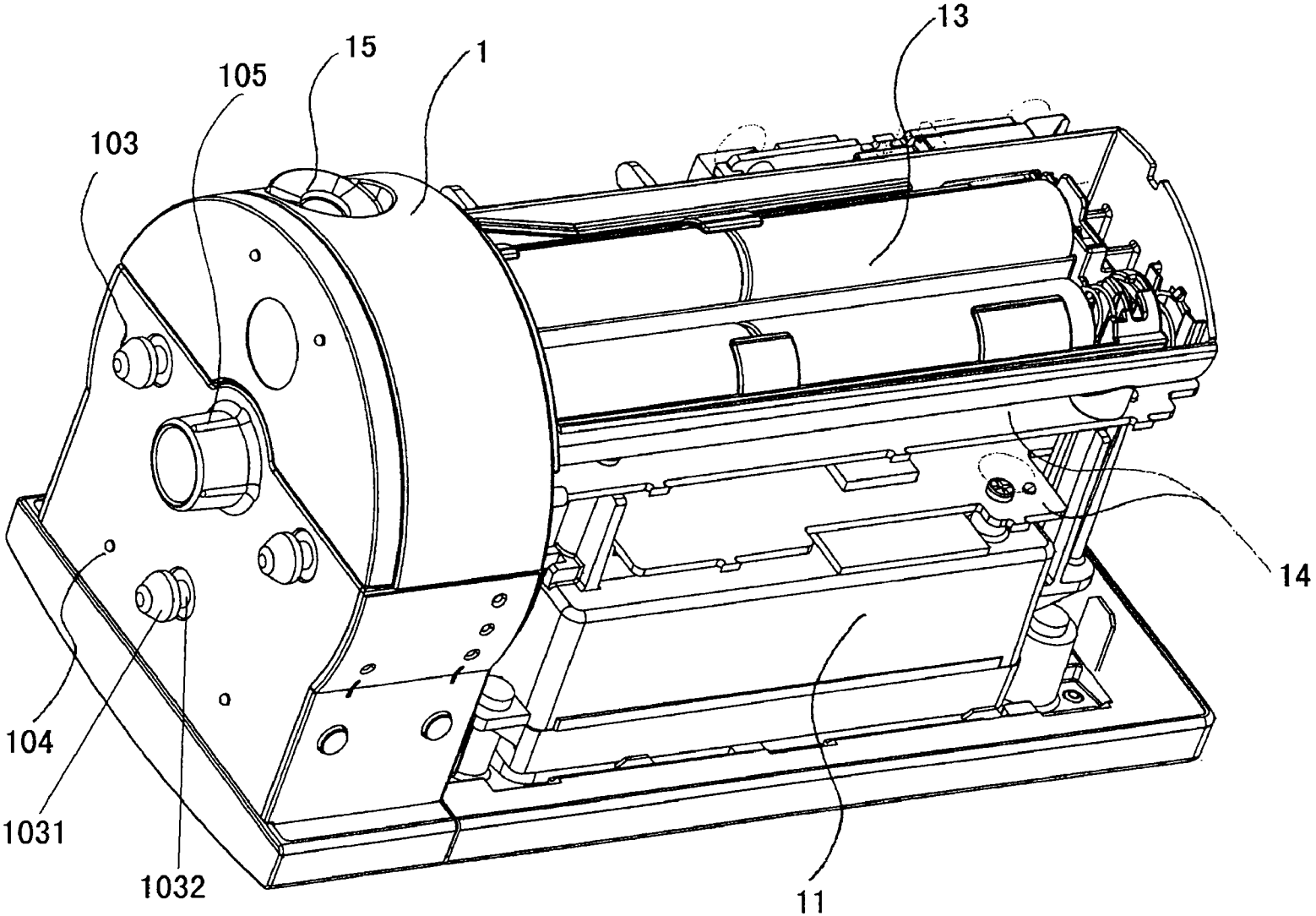
FIG. 3 is a schematic view of the inner structure of the first sound case shown in FIG. 2 with the cover opened.
Figure 8:
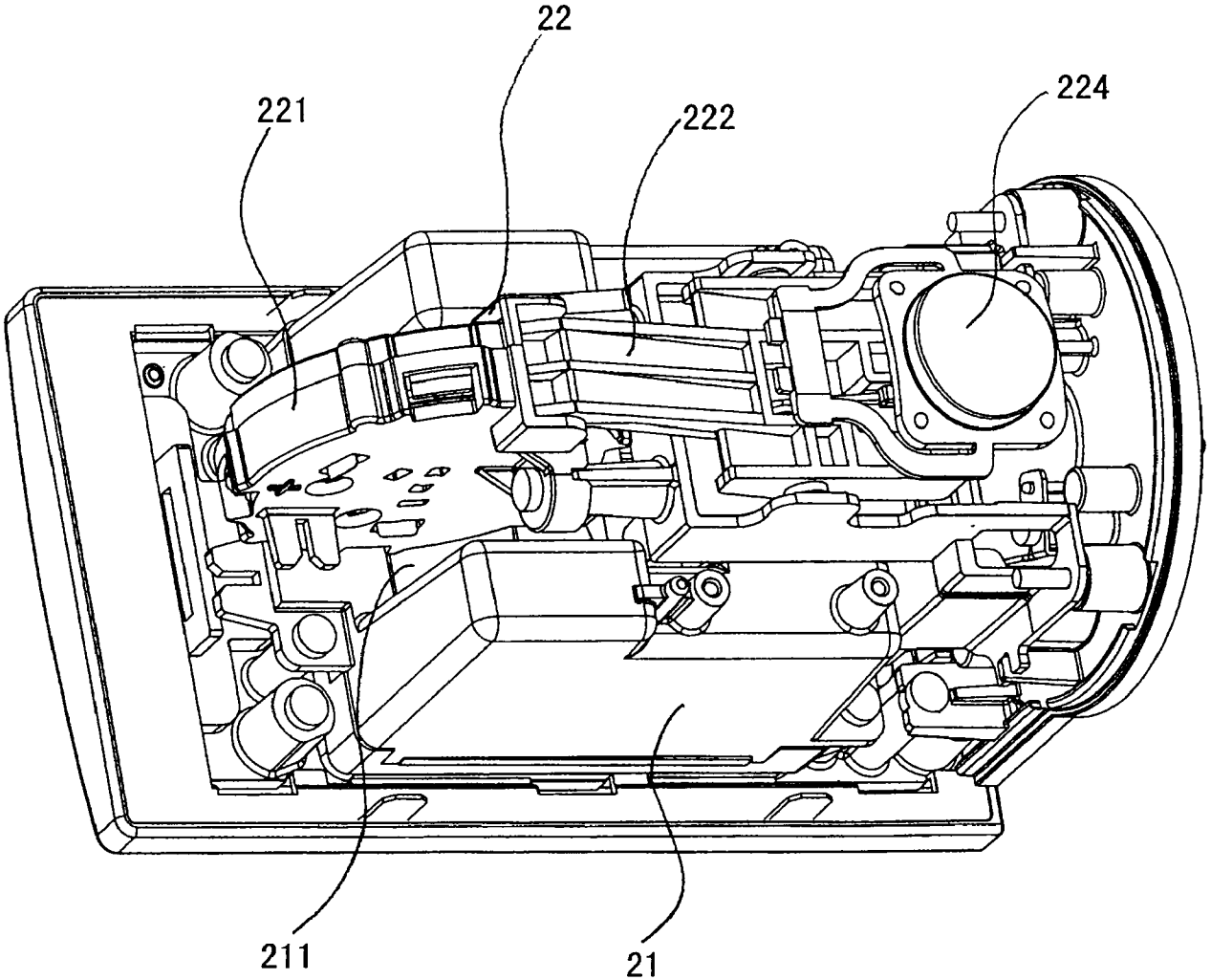
FIG. 8 is a schematic perspective view of the inner structure of the second sound case shown in FIG. 4 with the cover opened.

Referring to FIGS. 3, 8 and 11, two speaker portions 1 and 2 are connected by electro-wires 226, and a voice chamber (11, 21) containing at least one speaker 213 is provided in each of the speaker portions. In order to achieve the miniaturization of the speaker portions, as well as increase the production efficiency and decrease the production cost thereof, each of the speaker portions is provided preferably with only one voice chamber (11, 21).

In order to achieve the stereosonic effect, voice chambers 11 and 21 of two speaker portions 1 and 2 can preferably have the different shapes from but substantially the same volumes as each other. It is understood that the term "substantially the same" used herein means that the volumes of two voice chambers 11, 21 can be identical or have the difference which should not bring about the difference in tone quality and volume an ordinary human ear can distinguish in the case that two voices chambers 11 and 21 are provided with the speakers with the same specifications.

In consideration of that the different parts may be provided in two speaker portions 1 and 2, for example, in one speaker portion 2 is provided winding mechanism 22 for retracting-in and pulling-out electro-wires 226, while in the other speaker portion 1 are provided cells 13 and circuit board 14 instead of winding mechanism 22, so that two voice chambers 11 and 21 may have the different shapes from each other. Also, the structure of the voice chamber is not limited to the conventional shape, for example, the rectangle, semi-cycle or cycle in section. In other word, the shapes of two voice chambers 11 and 21 can be varied depending on the shapes, positions and sizes of other parts provided in the speaker portions. For example, in the present embodiment, voice chamber 11 assumes the rectangle in section.

Preferably, the electronic apparatus of splittable type of the present invention comprises at least two speaker portions, wherein two speaker portions 1 and 2 are connected by electro-wires 226, one speaker portion 2 has winding mechanism 22 for retracting-in and pulling-out wires 226; each of speaker portions has a voice chamber, and voice chambers 11 and 21 of two speaker portions 1 and 2 have the different shapes from but substantially the same volumes as each other.

The connecting positions of electro-wires 226 can be at any positions in two speaker portions 1 and 2, preferably at the centers of first surface 10 and second surface 20.

Other Parts on the Outside of the Speaker Portions in the Embodiment

Figure 2:
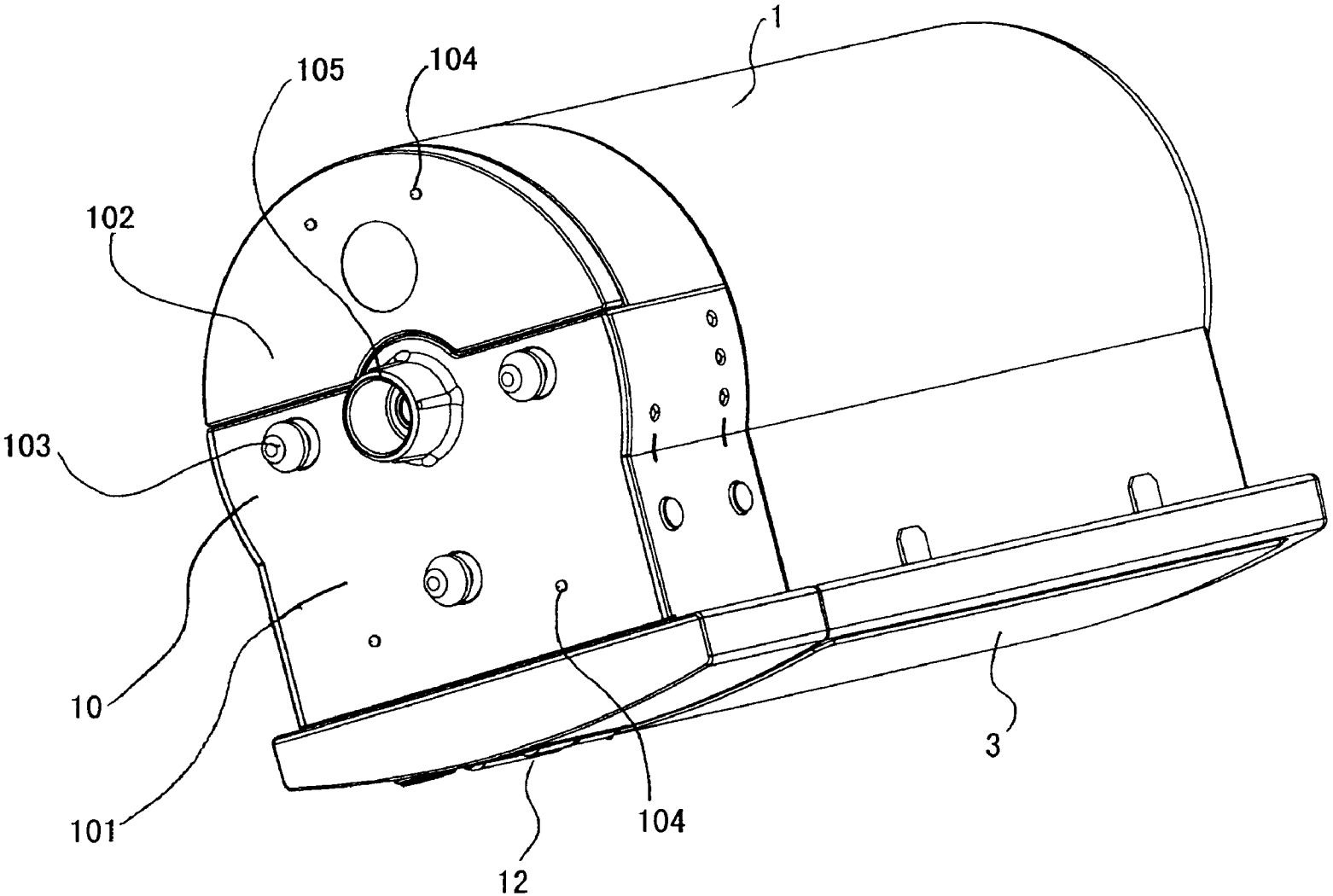
FIG. 2 is a schematic perspective view of the first sound case separated from the sound case of splittable type of the embodiment of the present invention.

As shown in FIGS. 2 and 3, on the surface of first sound case 1 are provided controlling key 12 for controlling music play and signal-inputting terminal 15, wherein controlling key 12 is provided at the end near the portion being jointed or separated on voice-outputting surface 3; and signal-inputting terminal 15 is provided at the end near the portion being jointed or separated on the semi-cylindrical surface of the semi-cylinder opposite to voice-outputting surface 3.

Winding Mechanism 22

Figure 4:
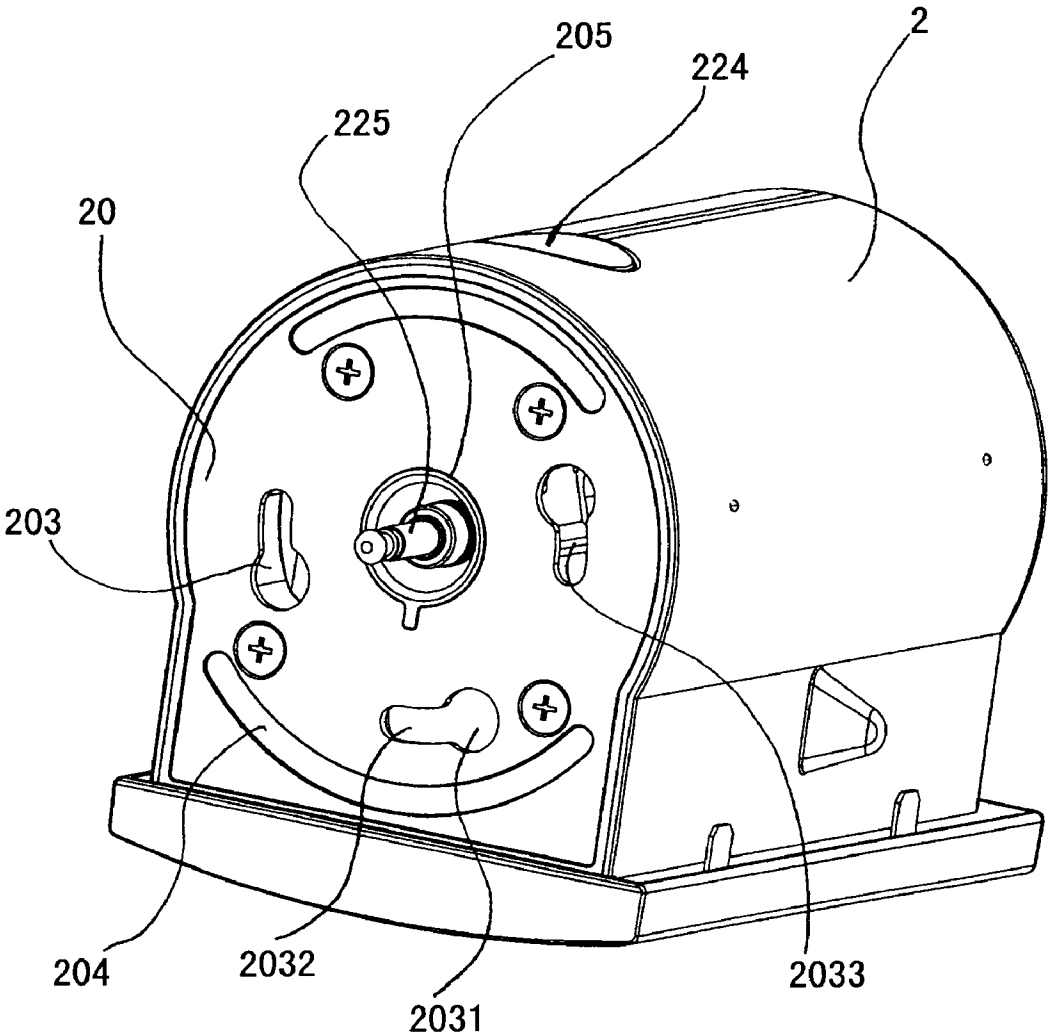
FIG. 4 is a schematic perspective view of the second sound case separated from the sound case of splittable type of the embodiment of the present invention.
Figure 5:
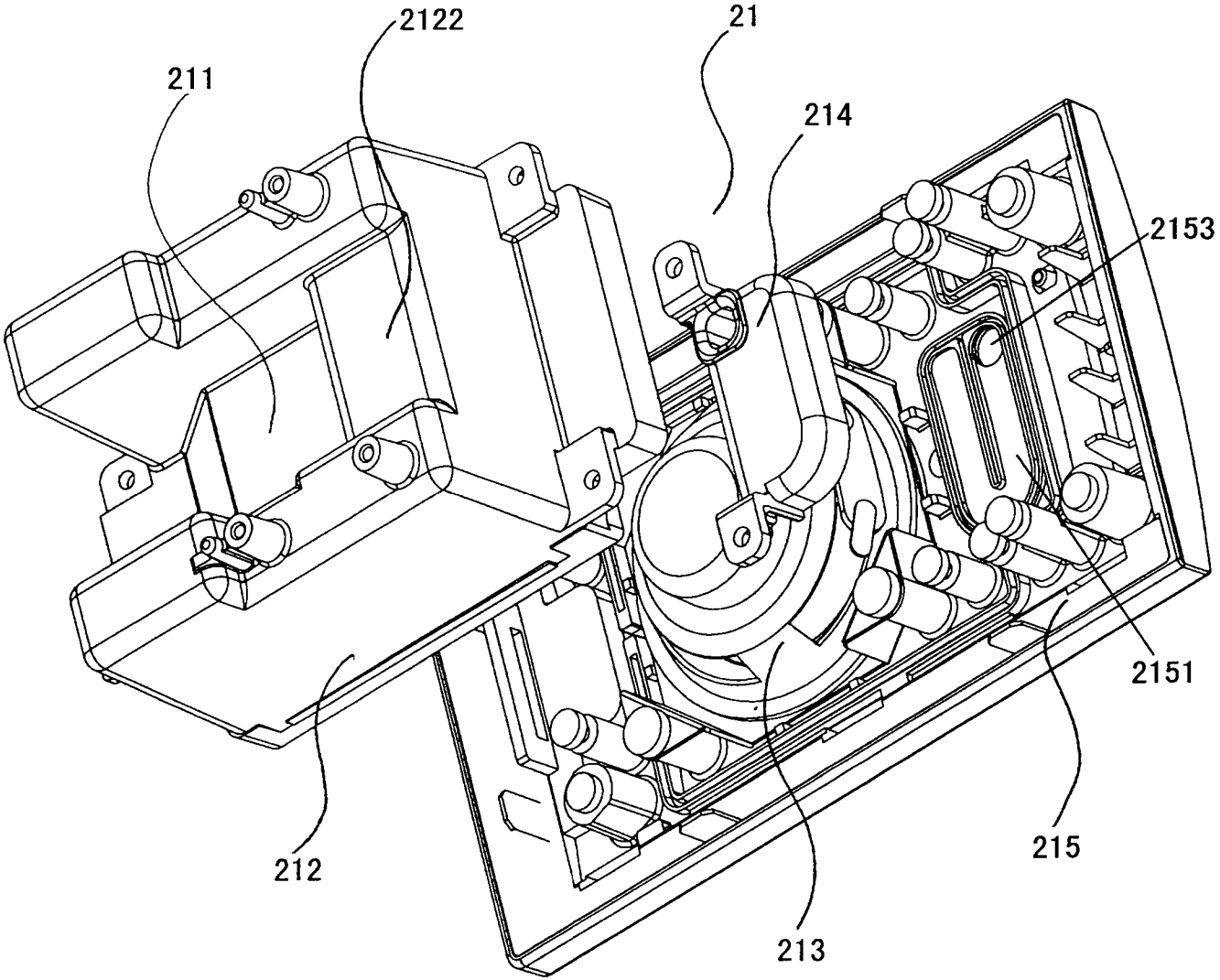
FIG. 5 is a schematic perspective view of the voice chamber separated from the second sound case shown in FIG. 4 and the inner structure thereof.
Figure 6:
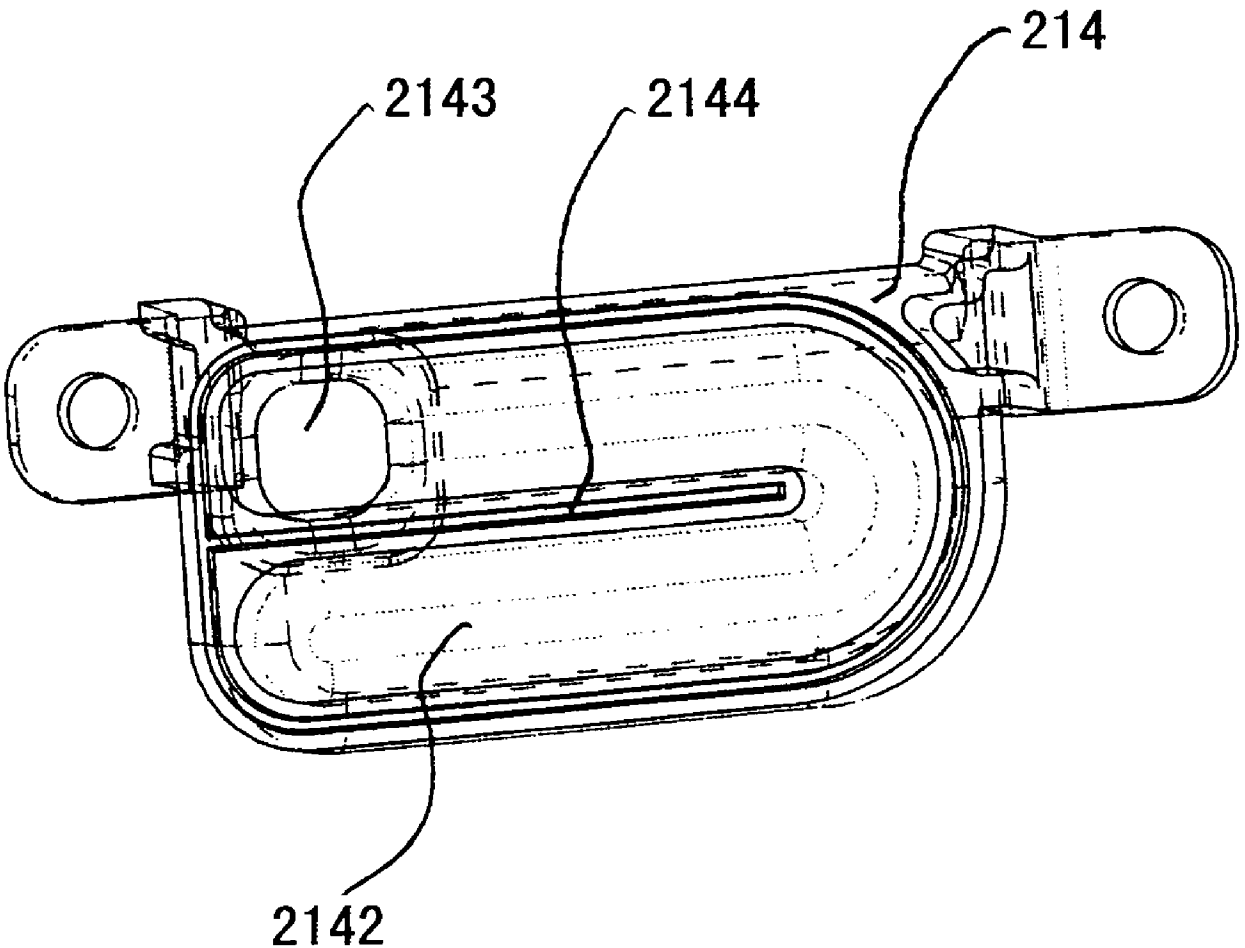
FIG. 6 is a schematic view of the inner structure of the groove-shaped voice-outputting module shown in FIG. 5 positioned in the voice chamber.
Figure 9:
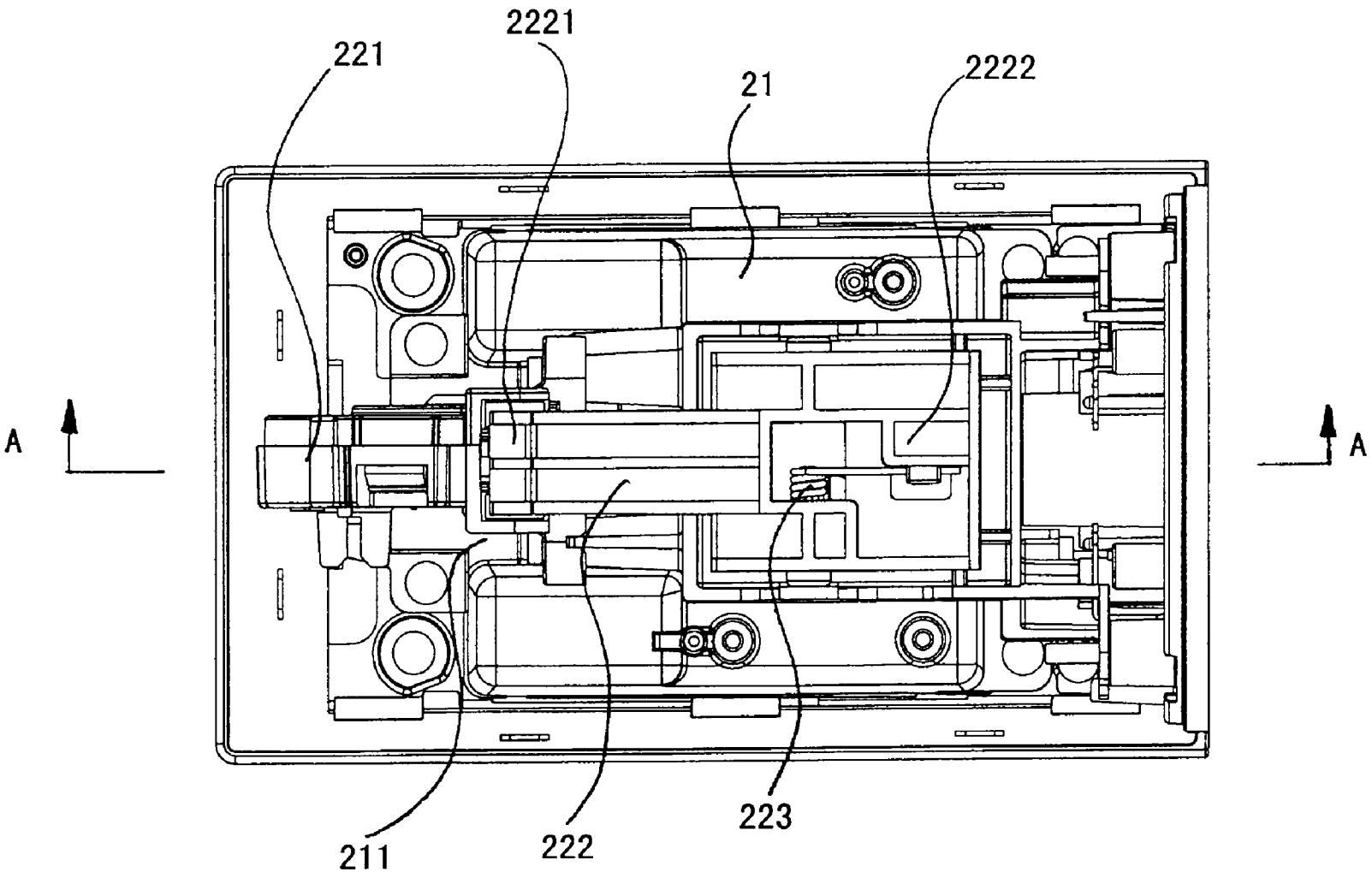
FIG. 9 is a top view of the inner structure of the second sound case shown in FIG. 8 with the cover opened and the retracting key removed.
Figure 10:
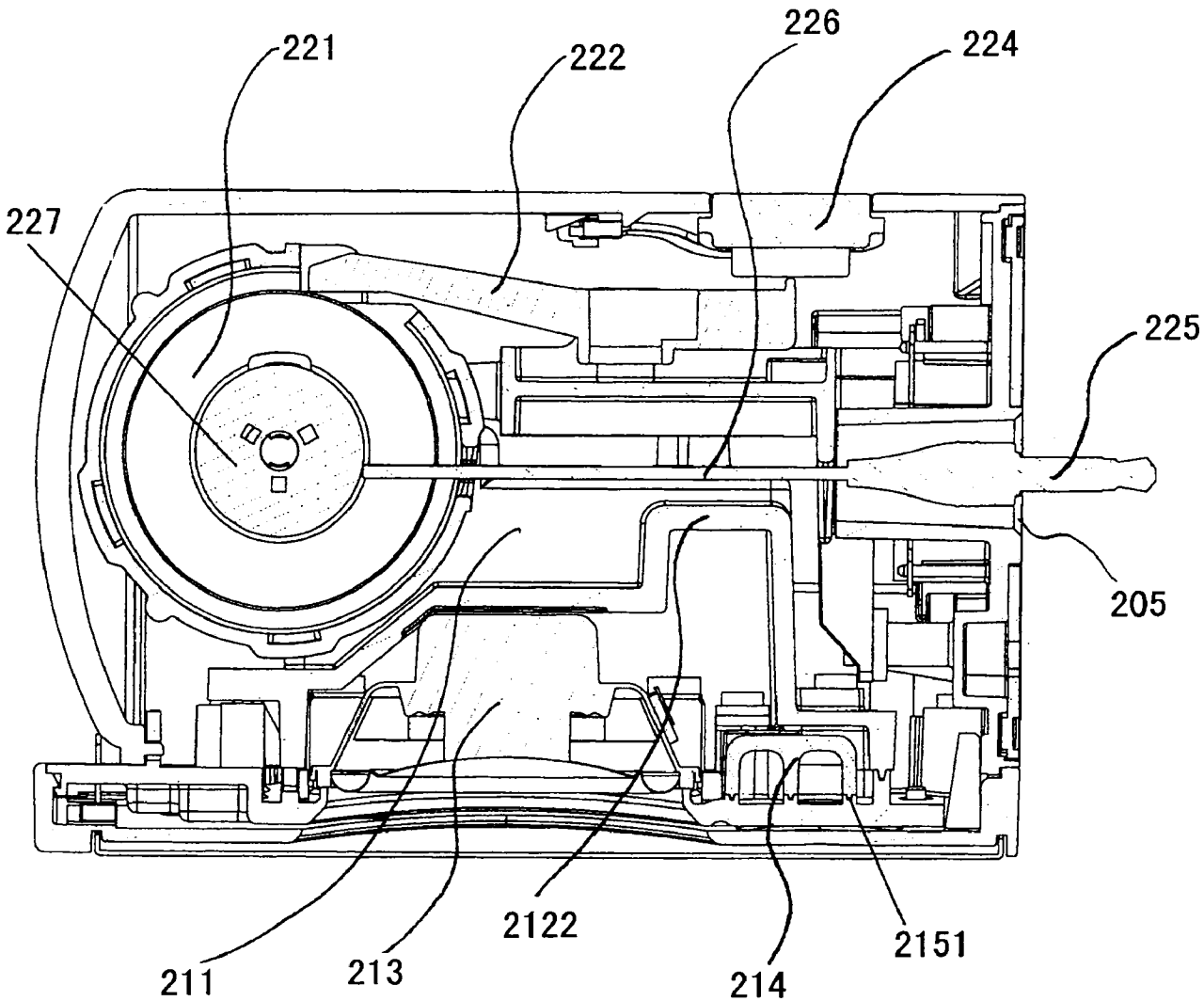
FIG. 10 is a sectional view of the second sound case taken along A-A line in FIG. 9.

Referring to FIGS. 8, 9 and 10, winding mechanism 22 of the present invention comprises retraction-controlling member 224 for controlling the automatic retraction of electro-wires 226. Retraction-controlling member 224 may be of a manually controlling type, in this case, the hand-accessible portion of retraction-controlling member 224 may be provided on the outer surface of the speaker portion. For example, in the embodiment, retraction-controlling member 224 is referred to as retracting key 224, and as shown in FIG. 4, retracting key 224 is provided at the position on second sound case 2 where the fingers can operate easily when second sound case 2 is held by one hand, for example, at the end near the portion being jointed or separated on the semi-cylindrical surface of the semi-cylinder opposite to voice-outputting surface 3, thus, the appearance of the sound case of splittable type being used will not be affected, and the shape of its top portion is compatible with the surrounding cylindrical surface and integrated therewith.

In addition to retraction-controlling member 224, winding mechanism 22 comprises:

a wire roll 227 for winding electro-wires 226 with connector 225 electro-connected with electro-wires 226 provided at the outputting end of electro-wires 226;

a ratchet unit 221 for generating rotary force in one rotating direction to drive wire roll 227 to rotate so as to wind electro-wires 226; and a ratchet-releasing mechanism 222 for locking and releasing the rotary force of ratchet unit 221.

Retraction-controlling member 224 controls the automatic retraction of electro-wires 226 by controlling ratchet-releasing mechanism 222 to release the rotary force, that is, in a normal case that retraction-controlling member 224 is not manipulated, retraction-controlling member 224 controls ratchet-releasing mechanism 222 to lock the rotary force, and wire roll 227 is driven by electro-wires 226 to rotate in the direction opposed to said rotating direction under the action of an external force against the rotary force, so that electro-wires 226 are pulled-out; when electro-wires 226 pulled-out should be retracted, retraction-controlling member 224 is manipulated so as to control ratchet-releasing mechanism 222 to release the rotary force, and wire roll 227 rotates in said rotating direction under the action of the rotary force of ratchet unit 221, so that electro-wires 226 pulled-out are retracted-in automatically onto wire roll 227.

It is understood that above term "locking" means that ratchet-releasing mechanism 222 inhibits the rotary force generated by ratchet unit 221 from acting on wire roll 227, in that time, ratchet unit 221 can rotate along with wire roll 227 in the direction opposed to said rotating direction in the case that the external force is larger than the rotary force. Above term "releasing" refers to the state that wire roll 227 rotates in the rotating direction to retract-in electro-wires 226 under the action of the rotary force generated by ratchet unit 221.

For example, as shown in FIGS. 8, 9 and 10, in the present embodiment, ratchet unit 221 provided coaxially with wire roll 227 comprises a ratchet having teeth in its periphery and a built-in leaf spring (not shown) which is engaged with the ratchet to make ratchet unit 221 generate the rotary force, in this time, the rebound force of the built-in leaf spring is the rotary force of ratchet unit 221. As a variation, ratchet unit 221 and wire roll 227 can be provided on the respective shafts engaged with each other. Ratchet-releasing mechanism 222 is a lever, and if the teeth of the ratchet are butted against an end of the lever, the rotary force from ratchet unit 221 is locked, and ratchet unit 221 can not drive wire roll 227 to rotate in the direction to retract-in electro-wires 226; when retracting key 224 is pressed, it presses rear end 2222 of lever 222 down to make front end 2221 thereof be lifted due to elimination of the action of the elastic force of small spring 223, so that the teeth of the ratchet are no longer butted against the end of the lever to release the rotary force of ratchet unit 221, thereby ratchet unit 221 rotates by means of the rotary force in said rotating direction to drive wire roll 227 for retracting-in electro-wires 226 pulled-out; when retracting key 224 is released, lever 222 returns to said butting state.

When two speaker portions 1 and 2 are electro-connected or electro-disconnected, winding mechanism 22 can control pulling-out and retracting-in of electro-wires 226 conveniently and control the length of electro-wires 226 pulled-out, so that the shortcoming of the prior art that speaker portions 1 and 2 must be electro-connected using external electro-wires when being used, the external electro-wires must be removed and otherwise stored after being used is resolved.

Jointing Mechanism

As described above, in the electronic apparatus of splittable type of the present invention, because two speaker portions 1 and 2 must be used in combine, the jointing mechanism for jointing or separating two speaker portions 1 and 2 is necessary. Referring to FIGS. 2 and 4, the jointing mechanism comprises at least first surface 10 provided on one of two speaker portions, for example, speaker portion 1, and second surface 20 provided on the other, that is, speaker portion 2, and first surface 10 and second surface 20 are opposed to each other when two speaker portions 1 and 2 are jointed together by the jointing mechanism.

The jointing mechanism further comprises other parts, which are coordinated with first surface 10 and second surface 20 to joint and separate two speaker portions 1 and 2. Referring to FIG. 3, in order to joint and separate them well, the jointing mechanism preferably further comprises:

at least two pins 103 protruding from one of first surface 10 and second surface 20, for example, first surface 10, and being provided separately from each other; each of which comprises head 1031 and pillar 1032 connected with head 1031, wherein said head 1031 comprises a portion larger than said pillar 1032 in section;

at least three bosses 104 protruding from one of first surface 10 and second surface 20, for example, first surface 10, and being provided separately from each other;

pin-holes 203 provided on the other of first surface 10 and second surface 20 no pin 103 protrudes from, for example, second surface 20, each of which corresponds to respective pin 103 and has key-inserting-hole part 2031 for entering and exiting of said pin 103 and extending-hole part 2032 communicated with key-inserting-hole part 2031 for moving of pillar 1032 therein, wherein the size of extending-hole part 2032 in the direction perpendicular to the extending direction is smaller than that of key-inserting-hole part 2031; and butt-sliding areas 204 provided on the other of first surface 10 and second surface 20 no boss 104 protrudes from, for example, second surface 20, each of which corresponds to the moving traces bosses 104 left thereon when two speaker portions 1 and 2 are jointed to or separated from each other.

When two speaker portions 1 and 2 are jointed together, firstly, to put first surface 10 and second surface 20 face to face, to insert head 1031 of each pin 103 into key-inserting-hole part 2031 of respective corresponding pin-hole 203, then to rotate first surface 10 with respect to second surface 20 in one direction; in this time, a repelling force is generated between first surface 10 and second surface 20 by moving pillars 1032 of pins 103 into extended-hole parts 2032 and butting bosses 104 against butt-sliding areas 204, and when each of pillars 1032 is moved to the end of extending-hole part 2032 in the extending direction, two speaker portions 1 and 2 are proposed in the jointing state by butting them against each other. On the contrary, when two speaker portions 1 and 2 jointed will be separated, firstly, to rotate first surface 10 with respect to second surface 20 in the direction opposite to said one direction to make pillar 1032 of each pin 103 return to key-inserting-hole part 2031, then to pull-out head 1031 of each pin 103 from respective corresponding key-inserting-hole part 2031 to separate two speaker portions 1 and 2.

In the above jointing mechanism, first surface 10 and second surface 20 are not limited in shape and size, preferably, two speaker portions 1 and 2 are the same in section, more preferably, they are matched with each other in size. For example, in the embodiment, in order to joint and separate easily, the sound case of splittable type has a neat and smooth shape in section, and for the purpose of conciseness and beauty of the sound case, first surface 10 of a speaker portion in which are provided cells 13 and circuit board 14 can further comprise two portions, one corresponding to cover 102 of cell box on the semi-circular top side, the other corresponding to main-body part 101.

In the above jointing mechanism, head 1031 and pillar 1032 of pin 103 are not limited to being circular in section, they are preferably circular in section, and more preferably, head 1031 assumes a cone shape. Preferably, there are provided three pins 103 distributed in equilateral triangle on the surface they protrude from.

In the above jointing mechanism, bosses 104 function to prevent rubbing between first surface 10 and second surface 20 when first sound case 1 and second sound case 2 are jointed or separated. As shown in FIGS. 2 and 3, in the embodiment, on first surface 10 are provided four minute bosses 104, two of them being provided on the portion corresponding to cover 102 of cells box, another two of them corresponding to main-body part 101. The height of boss 104 is preferably equal to or less than the difference resulting from subtracting the thickness of the plate the other surface belongs to from the height of pillar 1032 of pin 103 protruding from the surface where it seats. If the height of boss 104 is larger than said difference, only to do is to make butt-sliding areas 204 become recesses.

In the above jointing mechanism, bosses 104 and pins 103 protrude preferably from the same surface. However, it is possible to exchange the positions of bosses 104 and butt-sliding areas 204, that is, bosses 104 are provided on second surface 20, and butt-sliding areas 204 are provided on first surface 10.

In the above jointing mechanism, all key-inserting-hole parts 2031 have preferably the same extending directions therefrom on the same cycle. In the embodiment, all key-inserting-hole parts 2031 have preferably the same right-hand rotating directions on the same cycle. In order to achieve a better jointing effect, the length of extending-hole part 2032 should be enough to contain pillar 1032 of pin 103 protruding from the surface where it seats so as to joint closely first sound case 1 and second sound case 2 and make the jointed sound cases have the neat and smooth appearance and contour. The size of key-inserting-hole part 2031 should be fitted to the maximum size of head 1031 of pin 103 in section. Above key-inserting-hole part 2031 can have various shapes, preferably the circular shape convenient for machining processes on the surface where it seats.

In the above jointing mechanism, butt-sliding areas 204 are preferably made of a smooth wear-resisting piece made from PC (polycarbonate) or other materials with wearability not lower than PC, because the surface made from PC is smooth and wear-resisting and has the long lifespan. More preferably, each of butt-sliding areas 204 is configured to be an arc-shaped groove which is recessed from the surface where it seats and has the depth less than the height of said boss 104.

In order to maintain the firmness of two speaker portions 1 and 2 in the jointing state, in the above jointing mechanism, buckling members 2033 for buckling every pillar 1032 protruding from the other surface are preferably provided inside the surface where extending-hole parts 2032 seat to position accurately every pin 103 in the jointing state. Buckling member 2033 is preferably a leaf spring 2033 provided inside extending-hole part 2032, which forms by being bent and folded a bulge protruding from one of two edges in the extending direction of extending-hole part 2032 to the other so as to buckle pin 103 between the end of extending-hole part 2032 and the bulge of leaf spring 2033 in the state that two speaker portions 1 and 2 are jointed. As a variation of buckling member 2033, above leaf spring 2033 can be extended to the inside of the surface where extending-hole part 2033 seats and bent and folded to form a bulge directed to the surface. As a variation of buckling member 2033, above leaf spring 2033 can be extended to the surface where extending-hole part 2033 seats and bent and folded to form a bulge directed to the surface. In brief, the bulge can protrude in the varied directions as long as it is positioned inside extending-hole part 2032 and buckles pillar 1032 of pin 103 between the end of extending-hole part 2032 and the bulge.

In order that the members having the corresponding and matching relationship in the jointing mechanism, for example, pin 103 and key-inserting-hole part 2031, can be matched quickly, in the above jointing mechanism, the jointing mechanism preferably further comprises guiding column 105 which protrudes from first surface 10 or second surface 20, for example, first surface 10, and is provided in the center of the surface it protrudes from; and guiding hole 205 which is provided in the position corresponding to said guiding column 105 on one of first surface 10 and second surface 20 other than the surface guiding column 105 protrudes from, for example, second surface 20, and which guiding column 105 can be rotated with respect to after it is inserted in. Said guiding column 105 and guiding hole 205 function as a rotating axle after they are engaged with each other when first sound case 1 and second sound case 2 are jointed or separated, so that pins 103 can align with and be inserted to key-inserting-hole part 2031 quickly and be avoided from scratching second surface 20.

In the above jointing mechanism, all key-inserting-hole parts 2031 preferably extend in the same direction and on the same cycle, and the center of the same cycle is the center of guiding column 105 or guiding hole 205 on the surface where key-inserting-hole part 2031 seats.

In the above jointing mechanism, the surface said guiding column 105 protrudes from is preferably the surface pins 103 protrude from. More preferably, guiding column 105, pins 103 and bosses 104 protrude from the same surface. The advantage of this design is that two speaker portions 1 and 2 can be conveniently jointed.

In the above jointing mechanism, there are provided more preferably three pins 103 distributed in equilateral triangle. Guiding column 105 is more preferably positioned at a midpoint of one side of the equilateral triangle.

In the above jointing mechanism, guiding column 105 assumes preferably a shape of shaft, accordingly, guiding hole 205 assumes a circular shape and has the size fitted to the diameter of guiding column 105. Most preferably, the main-body of guiding column 105 assumes a cycle or a ring in section.

In the above jointing mechanism, more than two bosses 104 can be butted commonly against one butt-sliding area 204. For example, referring to FIGS. 2 and 4, in the embodiment, when each of butt-sliding areas 204 is provided as a recess on second surface 20 and four bosses 104 are provided on first surface 10, on second surface 20 are preferably provided two butt-sliding areas 204 as recesses, which correspond to the moving traces left by two bosses 104 on the portion of cover 102 of cells box of first surface 10 when being rotated about guiding column 105, and the moving traces left by two bosses 104 on the main-body part 101 of first surface 10 when being rotated about guiding column 105 respectively; all of these two butt-sliding areas 204 are arc-shaped grooves, the surface of which is smooth and wear-resisting and made of PC; wherein two bosses corresponding to the portion of cover 102 of cells box and two bosses corresponding to main-body part 101 share one arc-shaped groove 204. In the preferred embodiment, these four bosses 104 and three pins 103 are distributed around guiding column 105, wherein four bosses 104 are provided closer to the periphery than pins 103 in the manner of one pair being opposed to the other, and two of pins 103 align with guiding column 105 and arranged with guiding column 105 as a midpoint.

In the above jointing mechanism, in guiding column 105 is preferably provided axially a center hole for allowing connector 225 to insert in, in which is provided a socket mechanism (not shown) for electro-connection; guiding hole 205 is used for passing electro-wires 226, so that it composes passing hole 205 for electro-wires 226, and a blocking member (not shown) is provided in passing hole 225 for electro-wires 226 inside the surface where the passing hole 225 seats, which is provided with a small hole for guiding electro-wires 226 to pass and used to block connector 225 to go further into the speaker portion when electro-wires 226 are retracted-in; connector 225 can be pulled-out manually from guiding hole 205 with electro-wires 226 following it, and when connector 225 is inserted into the socket mechanism, two speaker portions 1 and 2 are electro-connected. With such a structure, the following effects can be achieved, that is, two speaker portions 1 and 2 can be electro-connected, the number of connecting members can be reduced and the connection/disconnection can be performed quickly. Meanwhile, the concise appearance and convenient operation of two speaker portions 1 and 2 can be maintained as much as possible.

In the above jointing mechanism, the engaging force generated after connector 225 is inserted into the socket mechanism in guiding column 105 is preferably larger than the retracting force applied to electro-wires 226 by ratchet unit 221 in the releasing state. In this way, electro-wires 226 can be pulled-out manually, and retracted-in by retraction-controlling member 224 in the state that connector 225 is engaged with the socket mechanism, thereby, when two speaker portions 1 and 2 are jointed in the state that they are electro-connected by electro-wires 226, said electro-connection by electro-wires 226 can be maintained.

In the above jointing mechanism, inside a speaker portion in which winding mechanism 22 is provided, electro-wires 226 are preferably not contacted and rubbed with other members when being pulled-out and retracted-in, thereby electro-wires 226 are protected from being damaged when being pulled-out and retracted-in, the lifespan of the speaker portions can be prolonged.

Voice Chamber

As well known, the tone quality of a speaker portion is in direct proportion to the space of air flow i.e. volume of voice chamber (volume). There are several estimating indexes on the tone quality of a voice chamber, for example, the effect of basetone. Therefore, it is required that the voice chamber should have the structure in which the volume of voice chamber becomes as large as possible in the case that a speaker portion has a definite size. Meanwhile, in order to design an excellent basetone system, the sonic principles must be complied with.

For example, with a sound case, when listening to music, a listener typically faces the voice-outputting surface of a sound case, therefore, a sound case is typically designed in such a form that a sealed voice-outputting mechanism is attached to the vicinity of the speaker, and a voice-outputting tube is provided in the front of the mechanism, in this way, the propagation of voice can be controlled, that is, the voice emitted in all directions can be reflected from the walls of the voice chamber and then outputted via the voice-outputting tube to resonate with the speaker, so that the voice intensity can be superposed. In the present invention, however, in consideration of that other components, for example, winding mechanism, power supply, electro-wires, circuit board and like, should be contained in the sound case as much as possible, the structure of the conventional sound case with shape of cuboid should be modified and redesigned. In the same time, it must be assured that the tone quality of a modified voice chamber should be equivalent to that of a conventional voice chamber with the same volume so as to maintain an excellent stereosonic effect. In order to achieve this purpose, the present inventor has designed the following structure of voice chamber suitable to provide winding mechanism 22 therein through the meticulous calculations and the repeated tests.

Referring to FIGS. 5, 6, 7 and 10, in the speaker portion provided with winding mechanism 22 of the present invention is provided voice chamber 21. Voice chamber 21 comprises chamber 212, base plate 215 and voice-outputting module 214, wherein chamber 212 assumes a box shape with an opening on one side; outside chamber 212, a set of steps including at least two steps which are lowered in height one by one in the direction toward the opening is formed in the middle of the bottom wall facing the opening, chamber 212 is a "凹"-shaped chamber as viewed from at least one end of the set of steps, and the "凹"-shaped space with steps of chamber 212 is for winding mechanism 22; U-shaped frame 2151 is formed on base plate 215, voice-outputting hole 2153 is provided at the end of one arm of U-shaped frame 2151 on base plate 215, and speaker 213 is provided adjacently to U-shaped frame 2151 on base plate 215; voice-outputting module 214 assumes a box shape with an opening on one side with the shape of the opening fitted to U-shaped frame 2151, U-shaped groove 2142 fitted to U-shaped frame 2151 is formed inside voice-outputting module 214, and through-hole 2143 is provided on the bottom of the end of one arm, which corresponds to the other arm of U-shaped frame 2151, of U-shaped groove 2151; when the speaker portion is assembled, voice-outputting module 214 is mounted on base plate 215 with U-shaped frame 2151 inlayed on U-shaped groove 2142 thereof, chamber 212 is mounted on base plate 215 with voice-outputting module 214 and speaker 213 positioned therein. Voice-outputting module 214 is preferably positioned in the space corresponding to higher-step portion 2122 of chamber 212.

The purpose to provide voice-outputting module 214 in voice chamber 21 as described above is to increase the intensity of voice by forming a sealed U-shaped air-flow chamber between voice-outputting module 214 and base plate 215 after voice-outputting module 214 is mounted on base plate 215. Therefore, voice-outputting module 214 functions as a voice tube with straight shape in a voice chamber with a conventional shape.

The U-shaped air-flow chamber formed between voice-outputting module 214 and base plate 215 in said voice chamber 21 can also be designed in other shape, as long as it functions as a voice tube and assures that voice chamber 21 has the same tone quality as that of voice chamber 11.

It is understood that the above term "box shape" refers to a cubic shape which has a housing space therein and is not limited to a shape of cuboid. Therefore, 1. each surface of above voice chamber 21 is not limited to rectangle, but can be extended or deformed properly in two dimensions; 2. each surface is not limited to a plane, but can be extended or deformed properly in three dimensions.

It is understood also that the above term "step" means that the level of the outer surface of the speaker portion rises in a direction step by step and the outer surfaces on the different steps are substantially parallel to each other and may deformed properly. Also, the size and the shape of the step-shaped space depend on the suitability to house winding mechanism 22, this space combines compactly voice chamber 21 and winding mechanism 22 to increase the utilization ratio of the inner space in the speaker portion where it lies.

In the embodiment, as shown in FIGS. 5, 6, 7 and 10, the flanges are formed on the periphery of U-shaped groove 2142 and the upper edge of partitioning plate 2144 for partitioning the inner space of voice-outputting module 214 into a U-shaped space in voice-outputting module 214.

Accordingly, the slots are formed on the periphery of U-shaped frame 2151 and the upper edge of the middle ridge to engage hermetically with the flanges of above U-shaped groove 2142, thereby to form a sealed U-shaped air flow chamber from through-hole 2143 to voice-outputting hole 2153 after voice-outputting module 214 is mounted on base plate 215.

Figure 7:
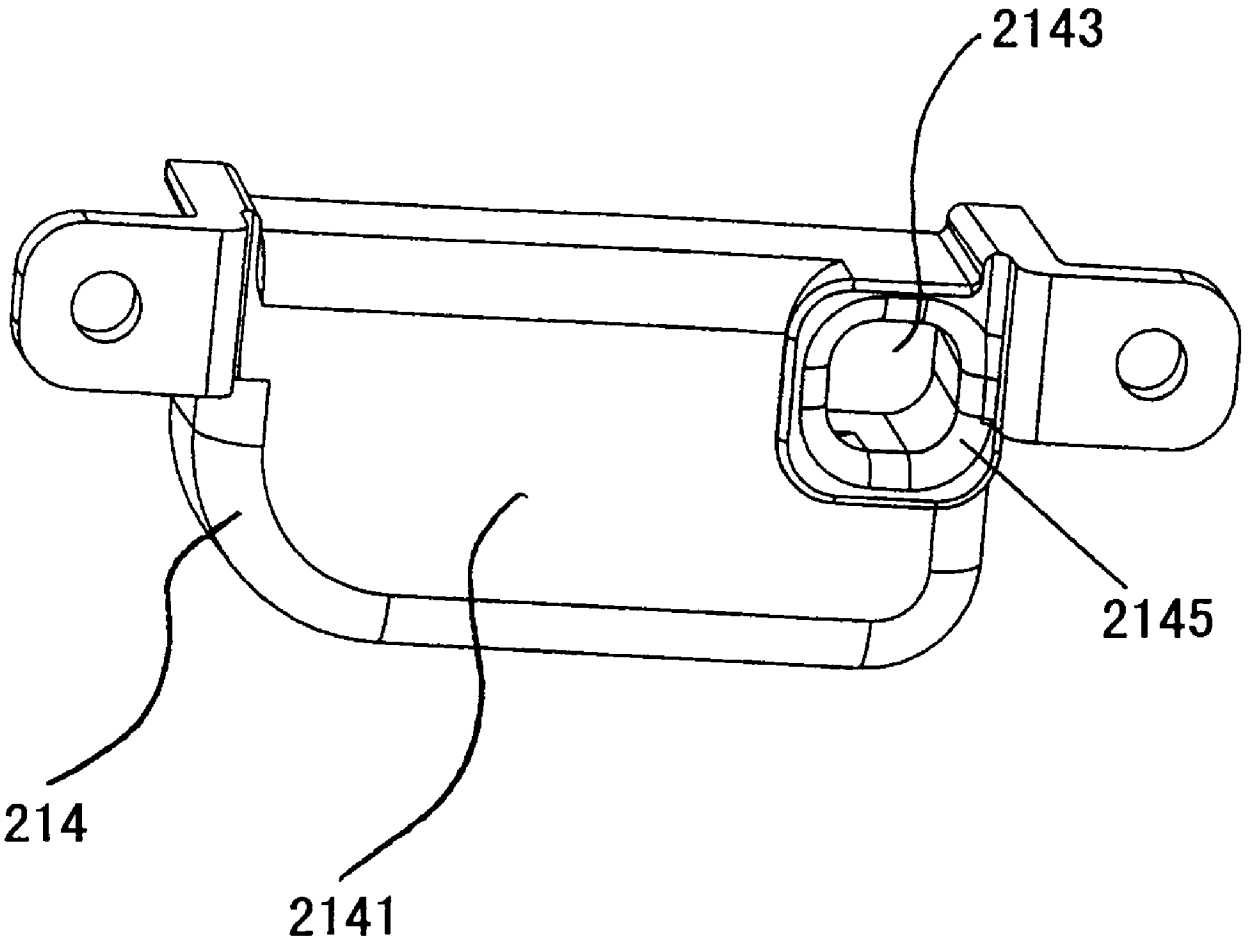
FIG. 7 is a schematic view of the outer structure of the bottom of the groove-shaped voice-outputting module shown in FIG. 6.

In the present invention, the sizes and the shapes of through-hole 2143 and voice-outputting hole 2153 can be the same or different. Referring to FIG. 7, through-hole 2143 is preferably formed with protruding structure 2145 which protrudes toward the outside of bottom 2141 of voice-outputting module 214 and assumes substantially a shape of megaphone.

Assembling of Second Sound Case 2 in the Embodiment

In the embodiment, as shown in FIGS. 8, 9 and 10, the step-shaped space formed in chamber 212 of voice chamber 21 in assembled second sound case 2 is concave chute 211 with step-shaped bottom, and winding mechanism 22 can be provided longitudinally along concave chute 211, wherein ratchet unit 221 and wire roll 227 are provided in the lower-step portion of the space in concave chute 211, and the direction electro-wires 226 go along is from the lower-step portion to higher-step portion 2122. In this way, the path electro-wires 226 go along in winding mechanism 22 is parallel to concave chute 211 and toward electro-wire hole 205, and the exit of electro-wires 226 in winding mechanism 22 and electro-wire hole 205 are all positioned higher than the height of higher-step portion 2122. Thus, electro-wires 226 will not be contacted with chamber 212 when being pulled-out and retracted-in so as to reduce rubbing between electro-wires 226 and chamber 212. Because two voice chambers 11 and 21 are controlled to have substantially the same volumes, second sound case 2 has the same tone quality as that of first sound case 1.

Operation of the Embodiment

When connector 225 is engaged with the socket mechanism, the sound case of splittable type can be jointed and separated as follows.

When being jointed, as shown in FIG. 11, firstly, to hold first sound case 1 and second sound case 2 using two hands respectively and to press retracting key 224 on second sound case 2, so that electro-wires 226 pulled-out are retracted-in naturally by means of the retracting force (that is, rotary force of ratchet unit 221) applied to electro-wires 226 by ratchet unit 221; then to interface guiding column 105 and guiding hole 205, to release retracting key 224, to align three pins 103 and key-inserting-hole parts 2031 of three pin holes 203 respectively and to insert pins 103 in, next, to rotate them slightly in right-hand direction, so that pillars 1032 of pins 103 protruding from first surface 10 are moved into extending-hole parts 2032, and when hearing or feeling a slight "click" or vibration from leaf spring 2033 indicating that pins 103 have been positioned, it means that the two sound cases are jointed. The jointed sound cases of splittable type can still be used as one sound case.

When being separated, in the opposite procedures, firstly, to rotate first surface 10 with respect to second surface 20 counterclockwise slightly until hearing or feeling a slight "click" or vibration from leaf spring 2033 indicating that pins 103 have been declutched, then to separate first sound case 1 from second sound case 2 to achieve the separation; and when being separated, it is possible to move first sound case 1 and second sound case 2 away by a desired space according to the requirement. During separating, because the engaging force between connector 225 and the socket mechanism is larger than the retracting force applied to electro-wires 226 by ratchet unit 221 in the releasing state, electro-wires 226 can be pulled-out from second surface 20 naturally and very conveniently without connector 225 disengaged from the socket mechanism.

As described above, the sound case of splittable type of the present invention has a compact structure and can keep an excellent tone quality, the operations for jointing and separating are simple and can be carried out quickly, when being firmly jointed and easily separated, first surface 10 and second surface 20 would not be scratched or damaged so as to maintain a complete and beautiful appearance of the surfaces of the sound cases even though being subjected to frequent uses, therefore, the lifespan can be prolonged, and the effects of miniaturization and portability can be achieved.

While a miniature portable sound case of splittable type as an embodiment of the technical solution of the present invention has been described in detail, it is obvious to those skilled in the art that the structures and the features of the present invention can also be applied to other electronic apparatuses of splittable type characterized by the electronic circuits and comprising at least two speaker portions. Therefore, those skilled in the art can make various variations and modifications according to the present invention without departure from the scope of the present invention as defined by the appendent claims and their equivalences.

The invention claimed is:

1. An electronic apparatus of splittable type, the electronic apparatus comprising:

two speaker portions, the two speaker portions connected by electro-wires, wherein a first speaker portion of the two speaker portions has a winding mechanism for pulling-out and retracting-in the electro-wires, each of the speaker portions having a voice chamber provided inside thereof, the voice chambers inside the two speaker portions having different shapes from and substantially same volumes as each other, the shape of the voice chamber inside the first speaker portion is compatible with a shape of the winding mechanism;

a jointing mechanism for jointing or separating said two speaker portions, said jointing mechanism comprising:

a first surface on one of the two speaker portions and a second surface on the other of the two speaker portions, the first surface and the second surface are opposed to each other when said two speaker portions are jointed by means of said jointing mechanism;

at least two pins protruding from one of the first surface and the second surface and being provided separately from each other; each of which comprises a head and a pillar connected with said head, wherein said head comprises a portion larger than said pillar in section;

at least three bosses protruding from one of the first surface and the second surface and being provided separately from each other;

pin-holes provided on the other of the first surface and the second surface which no pin protrudes from, each of which corresponds to a respective pin and has a key-inserting-hole part for entering and exiting of said pin and an extending-hole part communicated with the key-inserting-hole part for moving of the pillar therein, wherein a size of the extending-hole part in a direction perpendicular to an extending direction thereof is smaller than that of the key-inserting-hole part; and butt-sliding areas provided on the other of the first surface and the second surface which no boss protrudes from, each of which corresponds to moving traces the bosses left thereon, wherein when the two speaker portions are jointed together, firstly, to put the first surface and the second surface face to face, to insert the head of each pin into the key-inserting-hole part of the respective corresponding pin-hole, then to rotate the first surface with respect to the second surface in one direction; in this time, a repelling force is generated between the first surface and the second surface by moving the pillars of the pins into the extending-hole parts and butting the bosses against the butt-sliding areas, and when each of said pillars is moved to the end of the extending-hole part in the extending direction, the two speaker portions are proposed in a jointing state by butting them against each other, and when the two speaker portions jointed will be separated, firstly, to rotate the first surface with respect to the second surface in the direction opposite to said one direction to make the pillar of each pin return to the key-inserting-hole part, then to pull-out the head of each pin from the respective corresponding key-inserting-hole part to separate the two speaker portions.

2. The electronic apparatus according to claim 1, said jointing mechanism further comprising:

a guiding column which protrudes from the first surface or the second surface and is provided in a center of the surface it protrudes from; and a guiding hole which is provided in a position corresponding to said guiding column on one of the first surface and the second surface other than the surface the guiding column protrudes from, and which the guiding column can be rotated with respect to after it is inserted in.

3. The electronic apparatus according to claim 2, wherein the surface said column protrudes from is the surface the pins protrude from.

4. The electronic apparatus according to claim 2, said winding mechanism comprising:

a retraction-controlling member for controlling automatic retraction of said electro-wires;

a wire roll to wind said electro-wires with a connector electro-connected with the electro-wires being provided at an outputting end of the electro-wires;

a ratchet unit to generate a rotary force in one rotating direction to drive said wire roll to rotate so as to wind the electro-wires; and a ratchet-releasing mechanism to lock and release the rotary force of said ratchet unit, wherein said retraction-controlling member controls the automatic retraction of said electro-wires by controlling said ratchet-releasing mechanism to release the rotary force according to a normal case that the retraction-controlling member is not manipulated, the retraction-controlling member controls said ratchet-releasing mechanism to lock said rotary force, and the wire roll is driven by said electro-wires to rotate in the direction opposite to said rotating direction under action of an external force against said rotary force, so that the electro-wires are pulled-out; when the electro-wires pulled-out are retracted, said retraction-controlling member is manipulated so as to control the ratchet-releasing mechanism to release said rotary force, and the wire roll rotates in said rotating direction under action of the rotary force of the ratchet unit, so that the electro-wires pulled-out are retracted-in automatically onto the wire roll.

5. The electronic apparatus according to claim 4, wherein:

in said guiding column is provided axially a center hole, in which is provided a socket mechanism for electro-connection; and said guiding hole is used for passing the electro-wires and positioning said connector; the connector can be pulled-out manually from the guiding hole with the electro-wires following it, and when said connector is inserted into said socket mechanism, the two speaker portions are electro-connected.

6. The electronic apparatus according to claim 2, wherein there is provided three pins distributed uniformly in an equilateral triangle on the surface they protrude from.

7. The electronic apparatus according to claim 6, wherein said guiding column is positioned at a midpoint of one side of the equilateral triangle.

8. The electronic apparatus according to claim 1, wherein the voice chamber of the first speaker portion includes a chamber of concave shape which is compatible with the shape of the winding mechanism.

9. The electronic apparatus according to claim 1, wherein connecting positions of said electro-wires are at centers of the first surface and the second surface.

10. An electronic apparatus of splittable type, the electronic apparatus comprising:

two speaker portions, the two speaker portions connected by electro-wires, wherein a first speaker portion of the two speaker portions has a winding mechanism for pulling-out and retracting-in the electro-wires, each of the speaker portions having a voice chamber provided inside thereof, the voice chambers inside the two speaker portions having different shapes from and substantially same volumes as each other, the shape of the voice chamber inside the first speaker portion is compatible with a shape of the winding mechanism;

provided in the speaker portion provided with said winding mechanism, a voice chamber comprising a chamber, a base plate and a voice-outputting module, wherein said chamber assumes a box shape with an opening on one side, and outside the chamber, a set of steps comprising at least two steps which are lowered in height one by one in a direction toward the opening is formed in a middle of a bottom wall facing the opening, said chamber is a concave-shaped chamber as viewed from at least one end of the set of steps, and the concave-shaped space with steps of the chamber is for said winding mechanism; and a U-shaped frame formed on said base plate, a voice-outputting hole provided at an end of one arm of the U-shaped frame on the base plate, and a speaker provided adjacently to the U-shaped frame on the base plate, wherein said voice-outputting module assumes a box shape with an opening on one side with a shape of the opening fitted to the U-shaped frame, a U-shaped groove fitted to the U-shaped frame is formed inside the voice-outputting module, and a through-hole is provided on a bottom of the end of one arm, which corresponds to an other arm of the U-shaped frame, of the U-shaped groove, and when said speaker portion is assembled, said voice-outputting module is mounted on the base plate with the U-shaped frame inlayed on the U-shaped groove thereof, said chamber is mounted on said base plate with said voice-outputting module and said speaker positioned therein.

11. The electronic apparatus according to claim 10, further comprising:

a jointing mechanism for jointing or separating said two speaker portions, said jointing mechanism comprising a first surface on one of the two speaker portions and a second surface on the other of the two speaker portions, the first surface and the second surface are opposed to each other when said two speaker portions are jointed by means of said jointing mechanism.

12. The electronic apparatus according to claim 11, wherein connecting positions of said electro-wires are at centers of the first surface and the second surface.

13. The electronic apparatus according to claim 10, wherein said winding mechanism comprises a retraction-controlling member for controlling automatic retraction of said electro-wires.

14. The electronic apparatus according to claim 13, said winding mechanism comprising:

a wire roll to wind said electro-wires with a connector electro-connected with the electro-wires being provided at an outputting end of the electro-wires;

a ratchet unit to generate a rotary force in one rotating direction to drive said wire roll to rotate so as to wind the electro-wires; and a ratchet-releasing mechanism to lock and release the rotary force of said ratchet unit, wherein said retraction-controlling member controls the automatic retraction of said electro-wires by controlling said ratchet-releasing mechanism to release the rotary force according to a normal case that the retraction-controlling member is not manipulated, the retraction-controlling member controls said ratchet-releasing mechanism to lock said rotary force, and the wire roll is driven by said electro-wires to rotate in a direction opposite to said rotating direction under action of an external force against said rotary force, so that the electro-wires are pulled-out; when the electro-wires pulled-out are retracted, said retraction-controlling member is manipulated so as to control the ratchet-releasing mechanism to release said rotary force, and the wire roll rotates in said rotating direction under action of the rotary force of the ratchet unit, so that the electro-wires pulled-out are retracted-in automatically onto the wire roll.

15. The electronic apparatus according to claim 10, wherein the voice chamber of the first speaker portion includes a chamber of concave shape which is compatible with the shape of the winding mechanism.

* * * * *